United States Patent [19]

Durnal

[11] 4,395,837

[45] Aug. 2, 1983

[54] TRIGGER PROTECTOR FOR FIREARMS

[76] Inventor: Robert E. Durnal, 4665 Alta Rica Dr., La Mesa, Calif. 92041

[21] Appl. No.: 218,699

[22] Filed: Dec. 22, 1980

Related U.S. Application Data

[63] Continuation-in-part of Ser. No. 108,539, Dec. 31, 1979, abandoned.

[51] Int. Cl.[3] ..... F41C 27/10

[52] U.S. Cl. ..... 42/1 Y

[58] Field of Search ..... 42/1 Y, 1 T; 5/451

[56] References Cited

U.S. PATENT DOCUMENTS

| | | | |
|---|---|---|---|
| 2,859,551 | 11/1958 | Buchanan | 42/1 Y |
| 3,022,596 | 2/1962 | Cannon | 42/1 Y |
| 4,110,927 | 9/1978 | Morris | 42/1 T |

OTHER PUBLICATIONS

Smith, Ned; "Sportman's Quiz"; *Sports Afield;* May 1970, p. 30.

*Popular Mechanics;* Feb. 1948; p. 146.

*Primary Examiner*—Charles T. Jordan

*Attorney, Agent, or Firm*—Brown & Martin

[57] ABSTRACT

A firearm trigger protector including a sheath having two sides dimensioned to enclose a trigger guard on a firearm, first, second and third straps and first and second hook and loop (Velcro) fasteners. The first strap has an unsecured end and is secured at its other end to one side of the sheath. The first hook and loop fastener has two mating portions. One mating portion is secured to the unsecured end of the first strap; and the opposite mating portion is secured to the sheath in a position to interact with the one mating portion of the first hook and loop fastener. The second and third straps are secured respectively at opposite sides of the first strap adjacent the position where the opposite mating portion of the first hook and loop fastener is secured to the sheath. The second and third straps are disposed for being wrapped over each other and the first strap when the first strap is wrapped around the firearm. The second hook and loop fastener has two mating portions respectively secured to the second and third straps for interacting with each other to bind the second strap to the third strap when the second and third straps are wrapped over each other and the first strap, to thereby prevent the first hook and loop fastener from being separated by pulling on the unsecured end of the first strap.

7 Claims, 5 Drawing Figures

TRIGGER PROTECTOR FOR FIREARMS

CROSS REFERENCE TO RELATED APPLICATION

This is a continuation-in-part of co-pending application No. 108,539 filed Dec. 31, 1979, now abandoned, for "Trigger Protector for Firearms."

BACKGROUND OF THE INVENTION

This invention relates to trigger protectors for firearms such as pistols, rifles and shotguns.

Trigger protectors have been made in the past such as disclosed, for example, in the U.S. Pat. No. 2,859,551, which issued on Nov. 11, 1958 to E. R. Buchanan. In this trigger protector, a metallic cup encloses the trigger quard of a firearm and is attached to the firearm by a pair of metallic straps which pass over the top of the firearm and are secured to the metallic cup by a lock. The principal disadvantage of this type of construction is that it takes a relatively long time to remove the trigger protector since it requires that a key be located and inserted into the lock and turned and removed before the straps can be taken off. Thus this type of trigger protector is not suitable when the firearm must be ready for instant use, as is required in many cases. Many other types of trigger protectors have been devised, but all of them use locks and thus, share in the principal disadvantage of the above-described trigger protector.

SUMMARY OF THE INVENTION

The present invention provides an inexpensive firearm trigger protector that can be used with firearms that must be ready for instant use. The firearm trigger protector of the present invention includes a sheath having two sides dimensioned to enclose a trigger guard on a firearm and to cover a trigger within the trigger guard for preventing the trigger from being pulled; a strap having an unsecured end and being secured at the other end to one side of the sheath; and a hook and loop fastener (such as a Velcro fastener) having two mating portions, with one mating portion being secured to the unsecured end of the strap on a first side of the strap that is adjacent the sheath when the strap is wrapped around the firearm, and the opposite mating portion being secured to the exterior of a side of the sheath in a position to interact with the one mating portion of the hook and loop fastener secured to the strap.

Although the hook and loop fastener of the present invention does not prevent children from removing the trigger protector, it does deter, or at least delay removal of the trigger protector by most younger children since they do not understand how to remove the hook and loop fastener.

Additional features of the present invention are described in relation to the description of the preferred embodiment.

BRIEF DISCUSSION OF THE DRAWINGS

DESCRIPTION OF THE PREFERRED EMBODIMENT

Figure 1:
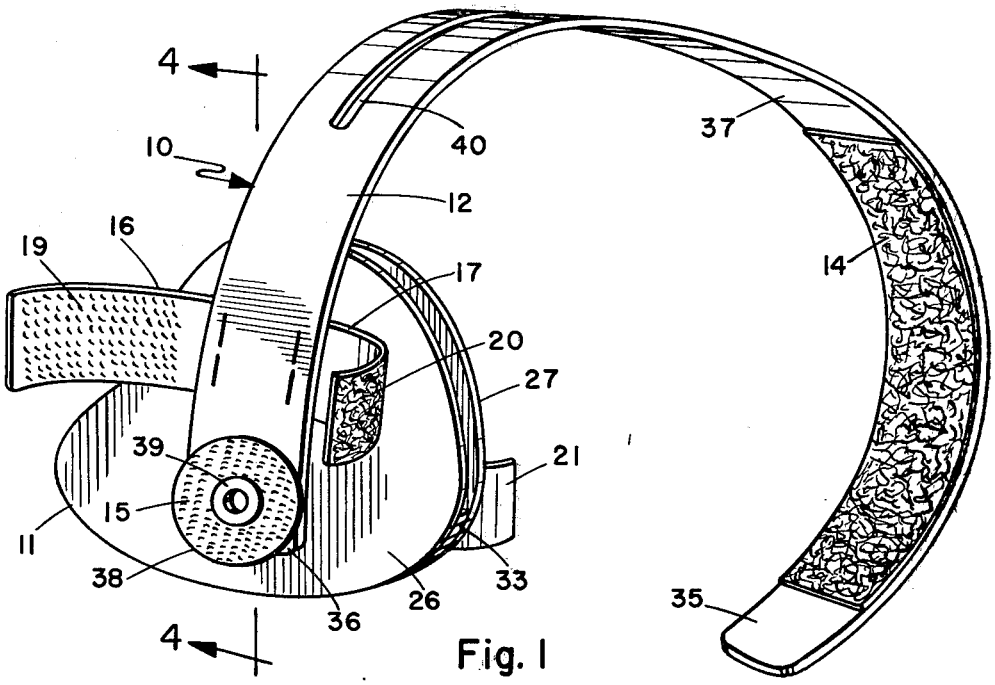
FIG. 1 is a perspective view of the preferred embodiment of the invention.

With reference to the Drawing, the preferred embodiment of a firearm trigger protector 10 includes a sheath 11, a first strap 12, a first hook and loop fastener consisting of two mating portions 14 and 15, a second strap 16, a third strap 17, a second hook and loop fastener consisting of two mating portions 19 and 20, a fourth strap 21, a fifth strap 22 and a third hook and loop fastener consisting of two mating portions 24 and 25.

In hook and loop type fasteners, the hook mating portion of the fastener contains a multiplicity of small plastic hooks while the loop mating portion contains a multiplicity of tiny plastic strands which are interwoven to create tiny loops. When the two portions are pressed together with light pressure, the hooks in the one portion engage the loops in the other portion. To release this fastener, all that is required is to pull the one portion away from the other. This is particularly important in this invention because it is desired to remove the trigger protector 10 from a firearm very quickly in cases where the firearm is to be ready for instant use.

Figure 2:
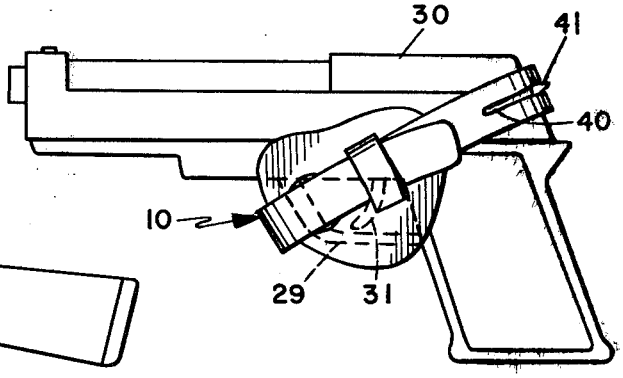
FIG. 2 is a side view showing the embodiment of FIG. 1 attached to an automatic pistol.

The sheath 11 has two sides 26, 27 dimensioned to enclose a trigger guard 29 on a firearm 30 (as shown in FIG. 2) and to cover a trigger 31 within the trigger guard 29 for preventing the trigger 31 from being pulled. The bottom portion of the sheath 11 is closed by a spacer block 33 which joins the two sides 26, 27 of the sheath 11. The spacer block 33 extends up the perimeter of the sheath to enable the trigger guard 29 and trigger 31 to be completely enclosed and to reduce rocking of the sheath 11 on the trigger guard.

The sheath 11 is open above the block 33 and the top portions of the sides 26, 27 of the sheath 11 serve as flaps for covering a portion of the firearm 30 above the trigger guard 29 to prevent access to the trigger 31 from above and through the open sides of the trigger guard 29 when the protector 10 is wrapped around the firearm 30.

The first strap 12 has an unsecured end 35 and is secured at its other end 36 to one side 26 of the sheath 11.

The first hook and loop fastener has two mating portions 14 and 15. The loop mating portion 14 is secured to the unsecured end 35 of the first strap 12 on the first side 37 of the strap 12 that is adjacent the sheath 11 when the first strap 12 is wrapped around the firearm 30. The hook mating portion 15 is secured to the exterior of a side 26 of the sheath 11 in a position to interact with the one mating portion of the first hook and loop fastener secured to the first strap 12. The hook mating portion 15 is attached to a nylon washer 38 through which a rivet 39 is disposed to secure the hook mating portion 15 and the secured end 36 of the first strap 12 to the side 26 of the sheath 11. The first strap 12 may be swiveled about the rivet 39. This permits the trigger protector 10 to be used with firearms which have different positions of the hammer and also to be used in bolt action rifles where the bolts are in differing positions. The nylon washer 38 may be used to expedite swiveling and helps to prevent the rivet 39 from being pried loose.

The second strap 16 and the third strap 17 are respectively secured at opposite sides of the first strap 12 to either the first strap 12 or the sheath 11 adjacent the position where the hook mating portion 15 of the first hook and loop fastener is secured to the sheath 11. The second and third straps 16, 17 are disposed for being wrapped over each other and the the first strap 12 when the first strap 12 is wrapped around the firearm 30. The second and third straps 16, 17 are positioned toward the unsecured end 35 of the first strap 12 from the position 39 where the hook mating portion 15 of the first hook and loop fastener is secured to the sheath 11.

The second hook and loop fastener has two mating portions 19 and 20 respectively secured to the second and third straps 16 and 17 for interacting with each other to bind the second strap 16 to the third strap 17 when the second and third straps are wrapped over each other and the first strap 12 to thereby prevent the first hook and loop fastener 14, 15 from being separated by pulling on the unsecured end 35 of the first strap 12 after the first strap 12 has been wrapped around the firearm 30 to cause the mating portion 14, 15 of the first hook and loop fastener to interact. The mating portion 19 is a hook mating portion; and the mating portion 20 is a loop mating portion.

The fourth and fifth straps 21 and 22 are respectively secured to the exterior of the opposite side 27 of the sheath 11 from where the hook portion 15 of the first hook and loop fastener is secured. The fourth and fifth straps 21, 22 are disposed for being wrapped over each other and the first strap 12 when the first strap 12 is wrapped around the firearm 30.

The third hook and loop fastener has two mating portions 24 and 25 respectively secured to the fourth and fifth straps 21 and 22 for interacting with each other to bind the fourth strap 21 to the fifth strap 22 when the fourth and fifth straps are wrapped over each other and the first strap 12 to thereby prevent the first strap 12 from being moved from the opposite side of the sheath 27 by rotation or a sliding motion which would enable the sheath 11 to be removed from the trigger protector 29 without having to unfasten the first hook and loop fastener 14, 15 that holds the first strap 12 to the sheath 11 when the strap 12 is wrapped around the firearm 30. The mating portion 24 is a hook mating portion, and the mating portion 25 is a loop mating portion.

The firearm trigger protector 10 further includes a fourth hook and loop fastener. The loop mating portion of the fourth hook and loop fastener is the loop mating portion 14 that is secured to the first side 37 of the strap 12. The hook mating portion 44 of the fourth hook and loop fastener is attached to a nylon washer 45 through which a rivet 46 is disposed to secure the hook mating portion 44 and the fourth and fifth straps 21, 22 to the side 27 of the sheath 11. The fourth and fifth straps 21, 22 thereby may be swiveled about the rivet 46 as the first strap is swiveled about the rivet 46 as the first strap is swiveled about the rivet 39 to make it possible for the fourth and fifth straps 21, 22 to be aligned normally to the first strap 12 regardless of the angle at which the first strap 12 is swiveled.

The loop mating portion 14 and the hook mating portion 44 of the fourth hook and loop fastener interact with each other when the first strap 12 is wrapped around the firearm 30 to thereby prevent the first strap 12 from being slid within the fourth and fifth strap 21, 22 when the fourth and fifth straps are wrapped around the first strap 12.

With each of the hook and loop fasteners the relative positions of the hook mating portions and the loop mating portions may be interchanged.

The first strap 12 includes a slit 40 in its central portion to prevent a hammer 41 of the firearm 30 to protrude therethrough, and thereby better hold the trigger protector 30 in a fixed position on the firearm 30.

Figure 3:
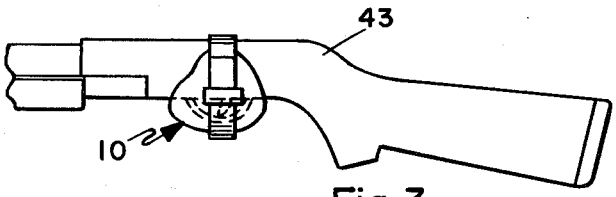
FIG. 3 is a side view showing the embodiment of FIG. 1 attached to an automatic shotgun.
Figure 4:
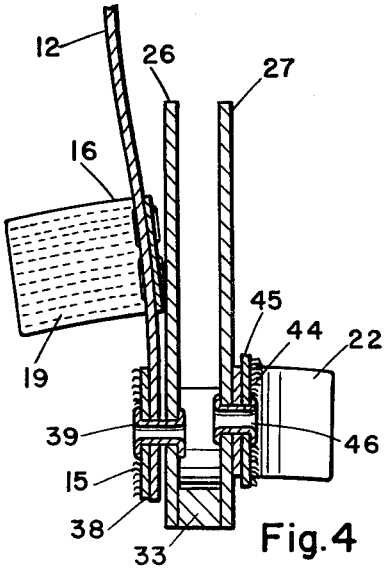
FIG. 4 is a vertical cross-section view taken through the sheath along the line 4—4 of FIG. 1 and showing the swivel attachment of the strap to the sheath.
Figure 5:
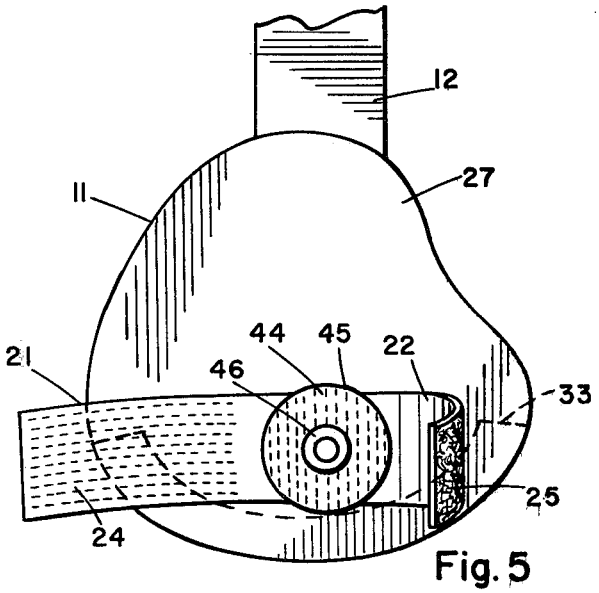
FIG. 5 is a side view showing the reverse side of the sheath shown in FIG. 1.

The firearm trigger protector 10 also may be used with a wide variety of firearms including a shotgun 43 (FIG. 3) and a rifle in addition to the handgun illustrated in FIG. 2.

The firearm trigger protector 10 of the present invention allows a handgun to be inserted in a holster with the trigger protector on the handgun.

The trigger protector 10 of the present invention is so constructed that it can be removed readily from a handgun while in darkness.

I claim:

1. A firearm trigger protector, comprising a sheath having two sides dimensioned to enclose a trigger guard on a firearm and to cover a trigger within the trigger guard for preventing the trigger from being pulled;

a first strap having an unsecured end and secured at its other end to one side of the sheath;

a first hook and loop fastener having two mating portions, with one mating portion being secured to the unsecured end of the first strap on a first side of the strap that is adjacent the sheath when the first strap is wrapped around the firearm, and the opposite mating portion being secured to the exterior of a side of the sheath in a position to interact with the one mating portion of the first hook and loop fastener secured to the first strap;

second and third straps respectively secured at opposite sides of the first strap to either the first strap or the sheath adjacent the position where the opposite mating portion of the first hook and loop fastener is secured to the sheath, wherein the second and third straps are disposed for being wrapped over each other and the first strap when the first strap is wrapped around the firearm;

a second hook and loop fastener having two mating portions respectively secured to the second and third straps for interacting with each other to bind the second strap to the third strap when the second and third straps are wrapped over each other and the first strap to thereby prevent the first hook and loop fastener from being separated by pulling on the unsecured end of the first strap after the first strap has been wrapped around the firearm to cause the mating portions of the first hook and loop fastener to interact.

2. A firearm trigger protector according to claim 1, further comprising fourth and fifth straps respectively secured to the exterior of the opposite side of the sheath from where the opposite portion of the first hook and loop fastener is secured and disposed for being wrapped over each other and the first strap when the first strap is wrapped around the firearm; and a third hook and loop fastener having two mating portions respectively secured to the fourth and fifth straps for interacting with each other to bind the fourth strap to the fifth strap when the fourth and fifth straps are wrapped over each other and the first strap to thereby prevent the first strap from being moved from the opposite side of the sheath.

3. A firearm trigger protector according to claim 2, further comprising a fourth hook and loop fastener having two mating portions, with one mating portion being secured to the first side of the first strap and the opposite mating portion being secured to the exterior of the opposite side of the sheath to interact with the one mating portion of the fourth hook and loop fastener secured to the first strap when the first strap is wrapped around the firearm.

4. A firearm trigger protector according to claim 3, wherein the opposite mating portion of the fourth hook and loop fastener is secured to the sheath at the position where the fourth and fifth straps are secured to the sheath.

5. A firearm trigger protector according to claim 4, wherein the opposite mating portion of the first hook and loop fastener is attached to a washer that is secured to the sheath for swiveling with respect to the sheath; and wherein the opposite mating portion of the fourth hook and loop fastener is attached to a washer that is secured to the opposite side of the sheath for swiveling with respect to the sheath.

6. A firearm trigger protector according to claims 1, 2, or 3 wherein the second and third straps are positioned toward the unsecured end of the first strap from the position where the opposite mating portion of the first hook and loop fastener is secured to the sheath.

7. A firearm trigger protector, comprising a sheath having two sides dimensioned to enclose a trigger guard on a firearm and to cover a trigger within the trigger guard for preventing the trigger from being pulled;

a first strap having an unsecured end and secured at its other end to one side of the sheath, and further including a slit in the central portion of the first strap to permit a hammer of the firearm to protrude therethrough, and a first hook and loop fastener having two mating portions, with one mating portion being secured to the unsecured end of the first strap on a first side of the strap that is adjacent the sheath when the first strap is wrapped around the firearm, and the opposite mating portion being secured to the exterior of a side of the sheath in a position to interact with the one mating portion of the first hook and loop fastener secured to the first strap.

* * * * *